US009447655B2

(12) United States Patent
Zhao et al.

(10) Patent No.: US 9,447,655 B2
(45) Date of Patent: Sep. 20, 2016

(54) METHODS FOR HANGING LINER FROM CASING AND ARTICLES DERIVED THEREFROM

(71) Applicants: Lei Zhao, Houston, TX (US); Zhiyue Xu, Cypress, TX (US)

(72) Inventors: Lei Zhao, Houston, TX (US); Zhiyue Xu, Cypress, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 237 days.

(21) Appl. No.: 14/054,289

(22) Filed: Oct. 15, 2013

(65) Prior Publication Data

US 2015/0101813 A1 Apr. 16, 2015

(51) Int. Cl.

| | |
|---|---|
| ***E21B 43/08*** | (2006.01) |
| ***E21B 43/10*** | (2006.01) |
| ***E21B 36/04*** | (2006.01) |
| ***E21B 36/00*** | (2006.01) |
| ***E21B 33/10*** | (2006.01) |
| ***E21B 33/12*** | (2006.01) |
| ***E21B 33/04*** | (2006.01) |

(52) U.S. Cl.

CPC ..... *E21B 36/00* (2013.01); *E21B 33/04* (2013.01); *E21B 33/10* (2013.01); *E21B 33/1212* (2013.01); *E21B 36/04* (2013.01); *E21B 43/10* (2013.01)

(58) Field of Classification Search

CPC ..... E21B 36/04; E21B 43/10; E21B 43/08

See application file for complete search history.

(56) References Cited

U.S. PATENT DOCUMENTS

| | | | | |
|---|---|---|---|---|
| 7,152,657 | B2 * | 12/2006 | Bosma | E21B 29/10 164/80 |
| 7,249,630 | B2 | 7/2007 | Wardlaw | |
| 2008/0210440 | A1 | 9/2008 | Stuart | |
| 2009/0090508 | A1 | 4/2009 | Brouse | |
| 2009/0283278 | A1 | 11/2009 | Huber | |
| 2011/0247832 | A1 | 10/2011 | Harris | |
| 2013/0087335 | A1 | 4/2013 | Carragher et al. | |

FOREIGN PATENT DOCUMENTS

WO WO2010059557 A2 5/2010

OTHER PUBLICATIONS

International Search Report and Written Opinion for International Application No. PCT/US2014/055875; International Filing Date Sep. 16, 2014; Report Mail Date Dec. 24, 2014 (14 Pages).

* cited by examiner

*Primary Examiner* — Catherine Loikith
(74) *Attorney, Agent, or Firm* — Cantor Colburn LLP

(57) ABSTRACT

A system comprises a casing; a liner that is disposed in the casing and that is concentric with the casing; and a layer of material disposed between the liner and the casing; where the layer of material forms a first bond with the liner and a second bond with the casing thereby enabling the liner to hang from the casing. A method for hanging the liner from the casing comprises disposing in a borehole a system comprising a casing; a liner that is disposed in the casing and being concentric with the casing; and a layer of material disposed between the liner and the casing; heating the system at a point proximate to the layer of material; and forming a first bond between the layer of material and the liner and a second bond between the layer of material and the casing.

11 Claims, 3 Drawing Sheets

METHODS FOR HANGING LINER FROM CASING AND ARTICLES DERIVED THEREFROM

BACKGROUND

This disclosure relates to methods for hanging liners from casing for articles used in downhole operations. It also relates to articles derived therefrom. In particular, the disclosure relates to methods for fusing liners to casing for articles used in downhole operations for oil and gas production activities.

Establishing and maintaining hydraulic integrity between liner hangers and a base casing in which they are set has long been one of the most problematic area facing operators involved in downhole operations. Current liner hanger systems, e.g., mechanical liner hangers, hydraulic liner hangers, balanced cylinders liner hangers, expandable liner hangers, all suffer from complex design (e.g., including both liner-top packer and liner hanger) and low reliability, adding additional costs during both manufacturing and maintenance (during their lifecycle). Most importantly, as oil and gas production activities continue to shift toward more hostile and unconventional environments, such as reservoirs with extremely high pressure high temperature (HPHT) conditions, corrosive sour environment (high in hydrogen sulfide and carbon dioxide), elastomers which are the main sealing materials used in liner-top packers, begin to decompose when temperature approach 600° F., causing safety and environmental risks thus limiting abilities for heavy oil exploration. There is therefore a need for a simple and rugged downhole joining design to connect a liner with a hanger through advanced solidifying expansion in hostile environments.

SUMMARY

Disclosed herein a system comprising a casing; the casing being disposed in a borehole; a liner; the liner being disposed in the casing and being concentric with the casing; and a layer of material disposed between the liner and the casing; where the layer of material forms a first bond with the liner and a second bond with the casing thereby enabling hanging the liner from the casing.

Disclosed herein too is a method comprising disposing in a borehole a system comprising a casing; the casing being disposed in a borehole; a liner; the liner being disposed in the casing and being concentric with the casing; and a layer of material disposed between the liner and the casing; heating the system at a point proximate to the layer of material; and forming a first bond between the layer of material and the liner and a second bond between the layer of material and the casing.

BRIEF DESCRIPTION OF FIGURES

FIG. 1(*b*) is another depiction of one exemplary embodiment of a system for hanging a liner from a casing;

FIG. 1(*c*) is another depiction of one exemplary embodiment of a system for hanging a liner from a casing;

FIG. 1(*d*) is another depiction of one exemplary embodiment of a system for hanging a liner from a casing;

FIG. 1(*e*) is another depiction of one exemplary embodiment of a system for hanging a liner from a casing;

FIG. 2(*b*) is another depiction of another exemplary embodiment of a system for hanging a liner from a casing;

FIG. 2(*c*) is another depiction of another exemplary embodiment of a system for hanging a liner from a casing;

FIG. 3(*b*) is another depiction of another exemplary embodiment of a system for hanging a liner from a casing; and

DETAILED DESCRIPTION

Figure 1C:
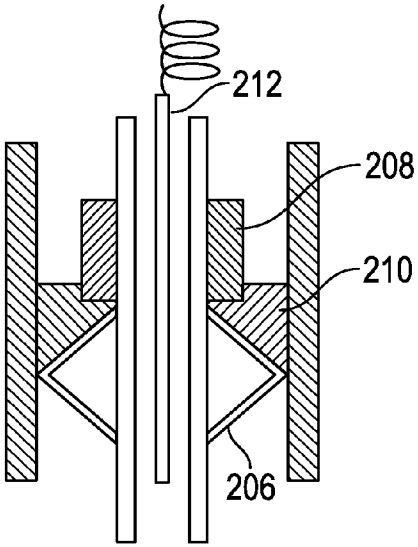
FIG. 1(*a*) is a depiction of one exemplary embodiment of a system for hanging a liner from a casing.
Figure 1B:
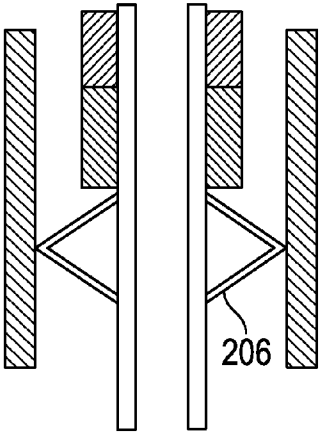
Figure 1A:
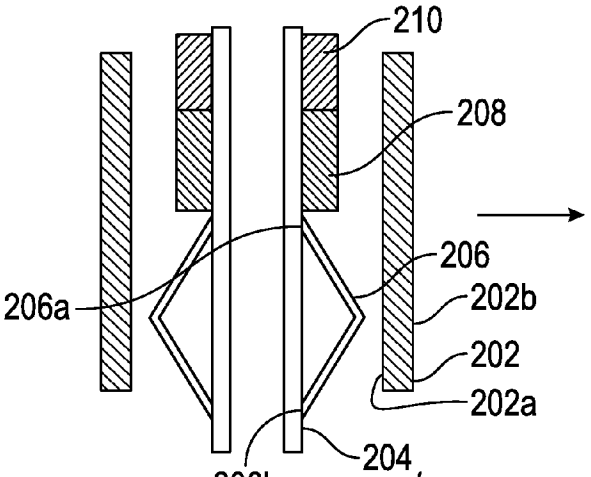
Figure 1D:
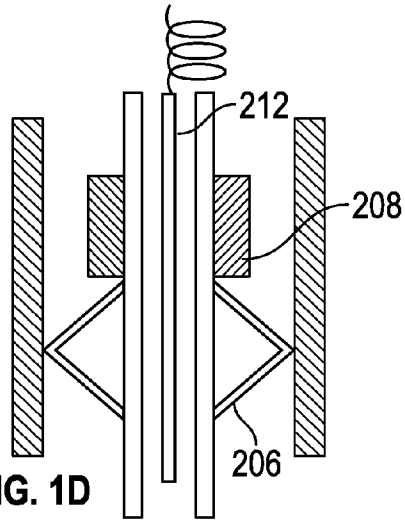
Figure 1E:
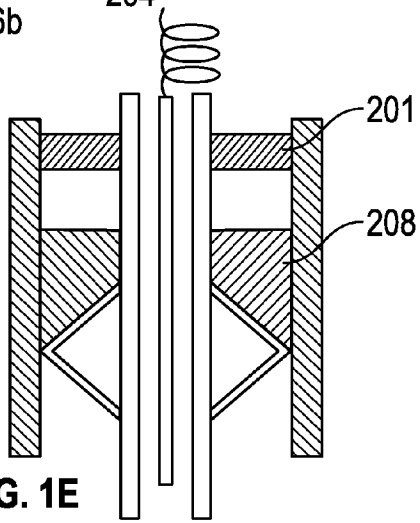

Disclosed herein is a system of hanging a liner to a base casing (hereinafter casing) to enable use of the system in downhole environments that would be inhospitable to other commonly used systems that do not use this method of bonding. This method of hanging the liner from the casing is conducted downhole and results in the formation of a bond between the liner and the casing. The bond referred to herein is a metallurgical bond and encompasses welds, brazing, weldments, and the like. In an embodiment, at least one of the bonds present in the system may be a physical bond (also sometimes called a mechanical bond), i.e., the liner is hung from the casing by friction produced by a tight fit.

In one embodiment, the bond between the liner and the casing is formed by melting a layer of fusible material such that it flows and contacts the liner and the casing. The molten layer of fusible material is supported by an expanded metal seal as it contacts the liner and the casing to form bonds as detailed below. Upon contacting the liner and the casing, the fusible material forms a bond with the liner and with the casing thus permitting the hanging of the liner from the casing. The layer of fusible material undergoes thermal expansion upon solidification from liquid to solid that provides a self-locking force that leads to a significantly improved hanging capacity when compared with conventional liner hangers that rely solely on metal to metal friction. The expansion during solidification ensures locking of the hanger to the liner. The fusible material can comprise materials shown in the Table 1. In an alternative embodiment, these fusible materials can also be ordinary brazing materials that can braze the liner with casing. Examples of brazing materials are boron-silver, boron-copper, boron-nickel, boron-cobalt, boron-gold and boron-palladium.

In another embodiment, the bond is created by atomic diffusion between a layer of expandable metal (that is affixed to the liner) and another metal alloy (that is affixed to the casing). In this embodiment, a layer of material (that is used to bond the liner with the casing) contacts the liner prior to forming the bond. The material is separated from the metal alloy by a very small distance. The bond is formed between the material and the casing as well as between the material and the liner. This method of bonding the liner to the casing is advantageous in that it does not require melting of the layer of material. The atomic diffusion leads to a significantly improved hanging capacity when compared with conventional liner hangers that rely solely on metal to metal friction.

In yet another embodiment, the bond is created between a reaction product of a highly exothermic reaction package and the metal of the casing. The reaction product is produced by a highly exothermic reaction package that is contained in a cup manufactured from an expandable material. The cup is welded or brazed to the liner around its entire circumference or along a portion of the circumference prior to the process that facilitates the hanging of the liner from the casing. The heat produced by the exothermic reaction creates a bond between the reaction product and the casing, thus facilitating hanging the liner from the casing. Since the cup is welded or brazed to the liner and since the reaction product forms a bond with the casing on the inner surface of the casing, a seal is formed that prevents fluid leakage in the annulus between the liner and the casing.

In one embodiment, the joining process to create the bond realizes the metal to metal sealing simultaneously and eliminates the need for the elastomer based liner-top packer. It thus not only reduces the cost by simplifying the liner hanger system design and setting-up, but enables operation in a high-pressure-high-temperature (HPHT) environment and more corrosive environments, increasing reliability of liner hanger system and improving the hydrocarbon recovery.

With reference now to the FIG. 1(*a*), a system 200 for bonding the liner 204 to the casing 202 comprises an expandable metal seal 206 that is in operative communication with the liner 204. The casing 202 has an inner surface 202*a* and an outer surface 202*b*. The outer surface 202*b* contacts a bore hole (not shown) via a layer of cement/concrete. An optional flux layer 210 and a layer of fusible material 208 also contact the liner 204 prior to downhole deployment of the system 200. The flux layer 210 is disposed atop the layer of fusible material 208. Both the flux layer and the layer of fusible material can exist in the form of rings which extend around the entire circumferential surface of the liner or can exist around a portion of the circumferential surface of the liner.

The expandable metal seal 206 is secured to the liner 204 at its upper end 206*a* and its lower end 206*b*. In one embodiment, both ends 206*a*, 206*b* of the expandable metal seal 206 are fixedly attached to the liner 204. In an embodiment, both ends 206*a*, 206*b* of the expandable metal seal 206 are welded, brazed or screwed onto the liner 204. In an exemplary embodiment, the expandable metal seal 206, the flux layer 210 and the layer of fusible material 208 all extend around the entire circumference of the liner 204. While the expandable metal seal 206 in the FIG. 1(*a*) is V-shaped, the expandable metal seal may have other shapes such as a U-shape, a W-shape, or the like. In one embodiment, the expandable metal seal 206 may comprise a single piece of linear expandable metal that contacts the liner and extends towards the inner surface of the casing. As can be seen in the FIG. 1(*a*), the upper surface of the expandable metal seal slopes downwards from the liner to the casing.

The expandable metal seal 206 is manufactured from a material that can expand to form a metal stop at downhole temperatures, which are typically greater than 80° C. In an exemplary embodiment, the expandable metal seal is manufactured from a copper alloy.

The expandable metal seal fills the space between casing and liner, functioning as "stopper" to prevent the leakage of flux and fusible metals along the liner after their melting. The expandable metal seal 206 supports the molten layer of fusible material when it melts thus permitting it to form a bond with the casing as well as with the liner. This will be detailed later. It is made from expandable metals that have a high ductility and a suitable yield strength. Exemplary materials for use in the expandable metal seal 206 are metals or metal alloys. As noted above, an exemplary metal used for the expandable metal seal is a copper alloy.

The layer of flux 210 comprises a material that can melt (if the material is crystalline) and flow or alternatively just flow (if the material is amorphous) at a desired temperature. The material used for the flux layer facilitates a removal of the contamination (e.g., drilling mud, oil, and the like,) present on an inner surface 202*a* of the casing 202. The flux also facilitates the removal of any metal oxidation layer present on an inner surface 202*a* of the casing 202 to enable efficient wetting of fusible layer on the casing surface during subsequent a joining process, which is described in detail below. For this application, a specific flux material is formulated, which can decompose at low temperature and cause no corrosion issue with their residues. The layer of flux has a lower melting point that the layer of fusible material. The flux may be capable of reacting with contamination present on the liner to facilitate its removal. Exemplary materials for use as the flux layer are halides (e.g., organic halide salts such as dimethylammonium chloride, diethylammonium chloride, and the like), organic acids (e.g., monocarboxylic acids such as formic acid, acetic acid, propionic acid, and the like, and dicarboxylic acids such as oxalic acid, malonic acid, sebacic acid, and the like) and polymeric resins.

The layer of fusible material 208 expands during solidification (i.e., when it changes from a liquid to a solid). This ability to expand upon solidification promotes frictional contact with both the liner and the casing, which enhances the hanging capability of the bond. It is desirable for the fusible material to have a high working temperature, has sufficient ductility to prevent a crack, has corrosion resistance to the ambient downhole environment and comprises a eutectic alloy to prevent phase segregation during processing.

Examples of suitable materials for the layer of fusible materials is seen in the Table 1 below:

TABLE 1

| Chemical composition | | Melting temperature (° C.) |
|---|---|---|
| Bi—Zn (bismuth-zinc) | | 256 |
| Bi—Ag (bismuth-silver) | | 263 |
| Ge—Al (germanium-aluminum) | | 420 |
| Ge—Ag (germanium-silver) | | 660 |
| Bi—Sb | 90:10 | 250 |
| Bi—Sb | 60:40 | 300 |
| Bi—Sb | 30:70 | 400 |
| Bi—Sb | 10:90 | 500 |
| Bi—Sb—Ag (30:60:10) | | 400 |

As seen in the Table 1 above, the materials used in the layer of fusible material have melting temperatures of 200 to 700° C., specifically 225 to 675° C., and more specifically 250 to 670° C.

FIGS. 1(*a*)-1(*e*) depicts one method of using the system 200. In one embodiment, in one method of activating the bonding between the liner 204 and the casing 202, the casing 202 along with the liner 204 (and the affixed expandable metal seal 206, the flux 210 and the layer of fusible material 208) are introduced downhole. At the downhole temperatures (which are typically greater than 80° C.), the expandable metal seal expands to contact the casing 202 (See FIG. 1(*b*).). An electrical heater 212 is then introduced into the liner. As the heater 212 heats the casing 202 and the liner 204, the flux (being the lower temperature melting material) melts (softens) and flows downwards around the expandable metal seal to contact the inner surface 202*b* of the casing. During this process any residual contamination is removed by the flux (See FIG. 1(*c*).). The contaminant removal by the flux may occur via a reaction between the material of the contaminant and the flux or alternatively, the contaminant may be physically removed by the fluid flow of the molten flux. Reaction between the flux and the contaminant along with fluid flow may also be used to remove contaminants.

As the heater further heats the liner 204, the fusible material also begins to melt and flows slowly from the liner 204 towards the casing on the upper surface of the expandable metal seal 206 (See FIG. 1(*d*).). The fusible material forms a bond with the liner 204, the upper surface of the expandable metal seal 206 and the casing 202 thus facilitating hanging the liner 204 from the casing 202 (See FIG. 1(*e*).).

The layer of fusible material also undergoes expansion upon solidification, which improves locking between the liner and the casing. The fusible material thus increases the frictional contact between the liner and the casing thus improving the hanging capacity of the liner from the casing. The layer of fusible material can also be a brazing alloy. Examples of brazing alloys are boron-silver, boron-copper, boron-nickel, boron-cobalt, boron-gold and boron-palladium.

Figure 2C:
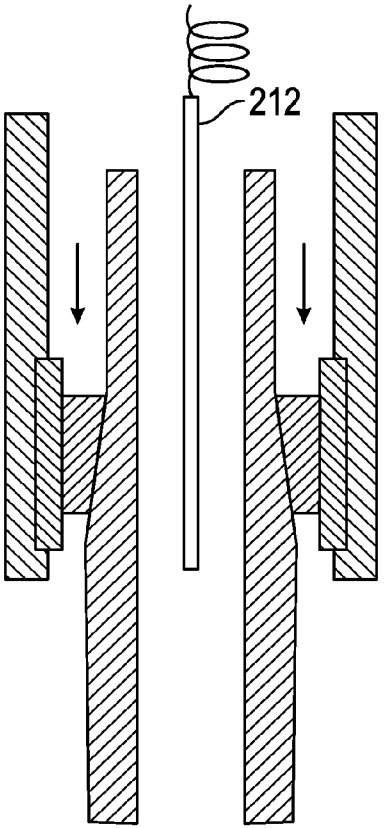
FIG. 2(*a*) is a depiction of another exemplary embodiment of a system for hanging a liner from a casing.
Figure 2B:
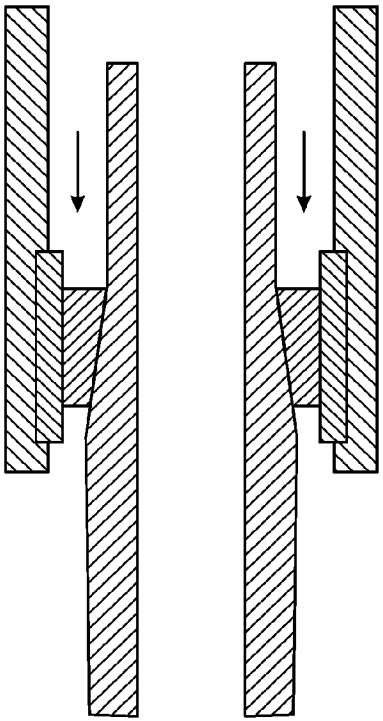
Figure 2A:
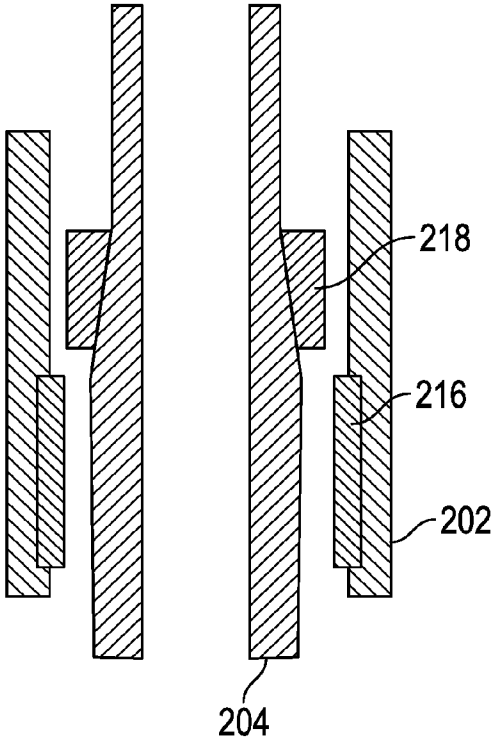

The FIGS. 2 (*a*)-2(*c*) depicts another method of hanging the liner 204 from the casing 202. The casing 202 has a tapered portion on which a layer of expandable metal 218 is disposed. The layer of expandable metal contacts a portion of the circumference or the entire circumference of the liner 204. The casing 202 has a metal layer 216 disposed on the inner surface 202*a* of the casing 202 and contacts the entire inner circumference or a portion of the entire inner circumference of the casing 202. The material used in the metal layer 216 can form a bond by atom diffusion with the layer of expandable metal 218, when they contact one another at elevated temperatures.

The method of deploying the system 200 is shown in the FIGS. 2(*a*)-2(*e*). The system 200 is introduced downhole and the casing 202 is cemented (not shown) to the borehole (See FIG. 2(*a*).). The liner 204 along with the layer of expandable metal 218 is then lined up with the casing so that the layer of fusible material contacts the metal layer 216 (that is disposed in the casing 202) (See FIG. 2(*b*).). The liner 204 can be optionally moved up or down or rotated to remove any contamination from the surface of the metal layer 216 and the casing by abrasion.

Prior to contacting the metal layer 216, there is a very small gap (typically on the order of micrometers) between the metal layer 216 and the layer of expandable metal 218. As the liner 204 is forced downwards, the layer of expandable metal 218 and the metal layer 216 are brought into contact with one another to form a tight fit. An electric heater 212 is then introduced into the liner to heat the system 200. The electric heater 212 is placed adjacent to the region where the layer of expandable metal 218 the metal layer 216 to form a tight fit. Upon heating to a suitable temperature, the expandable metal 218 forms a first bond with the metal layer by atomic diffusion. A second bond is formed between the expandable metal 218 and the liner, thus facilitating hanging the liner from the casing and sealing the region between the liner and the casing (See FIG. 2(*c*)).

This method has a number of advantages, notably that it can be used without any cleaning or fluxing step as seen in the process of the FIG. 1. The joining temperature (to form the respective bonds) is lower than the melting point of each component used in the layer of expandable metal 218 or the metal alloy 216). The microstructure of the joining materials is not influenced by the down hole joining process and thus a composite structure can be utilized to form a bond between the liner and the casing. This joint can be formed underwater and it can be realized in cement slurry (i.e., wellbore cementing can be conducted at the same time.)

Figure 3B:
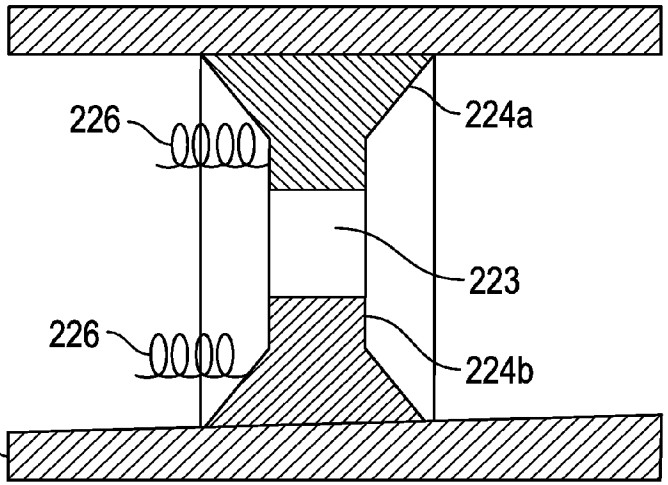
FIG. 3(*a*) is a depiction of another exemplary embodiment of a system for hanging a liner from a casing.
Figure 3A:
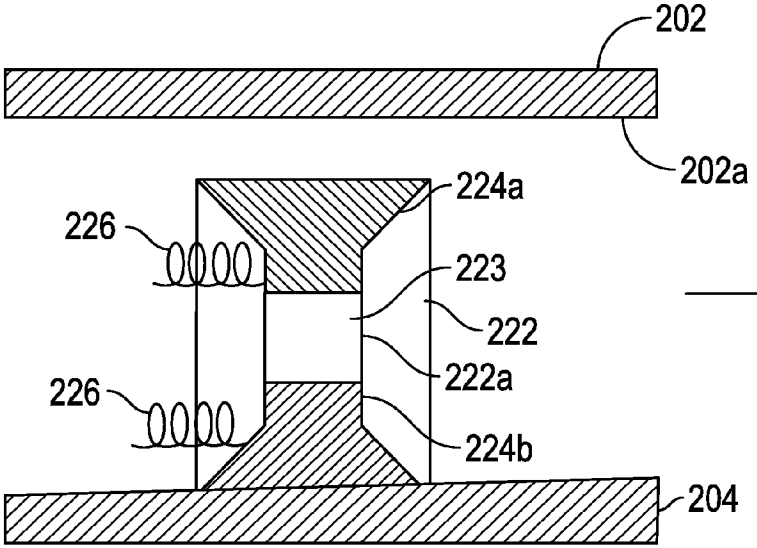

In yet another embodiment of the invention depicted in the FIG. 3(*a*)-3(*b*), the liner 204 can be hung from the casing 202 using an energetic material that upon heating produces the desired hanging of the liner from the casing. This method is advantageous in that no electrical heating is desired and no flux is used either. As seen in the FIG. 3(*a*), a tapered casing surface 204 that faces an inner surface 202(*a*) of the casing 202 has disposed upon it a cup 222 which contains a spring loaded device 223. Also present in the cup 222 is a first highly exothermic reaction package 224*a* and a second highly exothermic reaction package 224*b*. The first highly exothermic reaction package 224*a* is disposed on the spring loaded device 223 in the cup 222 and can facilitate bonding with the casing 202 upon being activated. The second highly exothermic reaction package 224*b* is disposed on the spring loaded device 223 in the cup 222 and can facilitate bonding with the liner 204 upon being activated.

When the exothermic reaction package is activated, it promotes an expansion of the cup 222 that causes the reaction products of the highly exothermic reaction package 224*a* to contact the casing 202 as well as the liner 204 and to form a bond between the products of the reaction package and the casing 202 as well as to form a bond between the products of the reaction package and the liner 204 thus facilitating a hanging of the liner from the casing.

The cup 222 comprises an expandable metal and is the same as that used in the expandable metal seal of the FIG. 1. In one example, the cup 222 may be manufactured from an Inconel alloy 718 (an alloy of nickel, iron, molybdenum, manganese, silicon, and/or chromium) and Incoloy 825 (an alloy of chromium, aluminum, titanium, copper, manganese, cobalt, nickel, silicon, sulfur and/or molybdenum). Disposed in the cup 222 in a hollow portion 222*a* are a spring loaded device 223 and the highly exothermic reaction packages 224*a* and 224*b*.

The spring loaded device 223 contains an expandable material (e.g., a mechanical expandable device such as a spring or a chemical composition such as expandable graphite) that forces the products of the highly exothermic reaction package outwards towards the casing and outwards towards the liner when either the spring loaded device, the respective highly exothermic reaction packages, or both the spring loaded device and the respective highly exothermic reaction packages are activated. The spring loaded device 223 should stay contracted in the cup 222 till activated and after being activated exerts a constant force on the reaction products of the highly exothermic reaction package that facilitates a bonding between the products and the casing and/or between the products and the liner.

In one embodiment, the spring loaded device comprises a spring that is activated when the respective highly exothermic reaction packages are activated. In other words, the highly exothermic reaction package is disposed in the cup in a manner such that it forces the spring to stay compressed until it (the reaction package) is activated. Upon being activated, the spring forces the first highly exothermic reaction package outwards to form a bond with the casing 202 and also forces the second highly exothermic reaction package outwards to form a bond with the liner 204. This formation of dual bonds facilitates hanging the casing from the liner. It is to be noted that the spring loaded device and the respective highly exothermic reaction package can be simultaneously activated or sequentially activated. In an exemplary embodiment, the respective highly exothermic reaction packages are activated prior to activating the spring loaded device.

In another embodiment, the spring loaded device 223 can comprise expandable graphite. The graphite expands on being exposed to elevated downhole temperatures and in conjunction with the activation of the highly exothermic reaction package forces the reaction products of the highly exothermic reaction package outwards (from the cup) to contact the casing and/or liner to effect the formation of bonds.

The highly exothermic reaction package 224*a* and 224*b* comprises thermite (a metal oxide reacted with a metal) and undergoes the following reaction (1) upon being activated.

$$2Al(s)+Fe_2O_3=Al_2O_3(s)+2Fe(s)$$

The reaction product of the highly exothermic reaction package is therefore a composition comprising alumina and iron. Copper thermite can also be used. The reaction (1) can be electrically activated by electric supply 226 and releases a tremendous amount of heat, which can expand the reaction products ($Al_2O_3$+2Fe). The activation of the highly exothermic reaction package also permits the spring loaded device to be activated thereby applying a force to the reaction package that promotes indirect bonding of the liner to the casing (See FIG. 3(*b*)) via the products of the reaction package. It is to be noted that the cup 222 may surround the entire circumference of the liner or only a portion of it.

It is to be noted that while in the FIGS. 1, 2 and 3, the heat depicted is electrical heat, other forms of heat such as microwaves, infrared heat, electron beam, inductive heating, laser heating and exothermic heating may also be used.

The methods described herein are advantageous in that the resulting direct or indirect bonding between the casing and the liner lead to significantly improved hanging capacity when compared with conventional liner hangers that rely solely on metal to metal friction. These processes are also advantageous because they eliminate the need for the elastomer based liner-top packer, which other conventional designs use. In some of the designs (See FIG. 1(*e*)), the bond is combined with a self-locking force originating from a volume increase during metal solidification process. In an embodiment, the system does contain an elastomer based liner-top packer 201 (See FIG. 1(*e*)) that is disposed atop the layer of material to prevent fluid flow in an annulus between the liner and the casing.

This method of hanging the liner from the casing not only reduces the cost by simplifying the liner hanger system design and set-up, but also enables operation in a high-pressure-high-temperature (HPHT) environment and more corrosive environments, increasing reliability of liner hanger system and improving the hydrocarbon recovery.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the invention not be limited to the particular embodiment disclosed as the best mode contemplated for carrying out this disclosure.

What is claimed is:

1. A system comprising:

a casing; the casing being disposed in a borehole;

a liner; the liner being disposed in the casing and being concentric with the casing;

a layer of material disposed between the liner and the casing; where the layer of material forms a first bond with the liner and a second bond with the casing thereby enabling hanging the liner from the casing; and a V-shaped expandable metal seal that is disposed below the layer of material, where the expandable metal seal contacts the liner at a first end and is operative to contact the casing at a second end that is opposedly disposed to the first end.

2. The system of claim 1, further comprising a flux layer that is disposed on the liner atop the layer of material; where the flux layer melts at a lower temperature than the layer of material.

3. The system of claim 2, where flux layer removes contaminants from the casing.

4. The system of claim 1, where the expandable metal seal supports the layer of material as it contacts the liner and the casing to form the first bond and the second bond.

5. The system of claim 1, where the system does not contain an elastomer based liner-top packer.

6. The system of claim 1, where the system does contain an elastomer based liner-top packer that is disposed atop the layer of material to prevent fluid flow in an annulus between the liner and the casing.

7. The system of claim 1, where the material is a fusible material and expands as it changes from a liquid state to a solid state.

8. The system of claim 7, where the fusible material is an alloy of bismuth-zinc, bismuth-silver, germanium-aluminum, germanium-silver, bismuth-antimony, bismuth-antimony-silver, or a combination thereof.

9. The system of claim 1, where an upper surface of the expandable metal seal slopes downwards from the liner to the casing.

10. The system of claim 1, where the first bond and/or the second bond is a metallurgical bond.

11. A method comprising:

disposing in a borehole a system comprising a casing; the casing being disposed in a borehole; a liner; the liner being disposed in the casing and being concentric with the casing; and a layer of material disposed between the liner and the casing; a V-shaped expandable metal seal that is disposed below the layer of material, expanding the expandable metal seal to contact the liner at a first end and to contact the casing at a second end that is opposedly disposed to the first end;

heating the system at a point proximate to the layer of material; and forming a first bond between the layer of material and the liner and a second bond between the layer of material and the casing.

* * * * *